United States Patent [19]

Hara et al.

[11] 4,216,650

[45] Aug. 12, 1980

[54] ALARM WRISTWATCH

[75] Inventors: Yoshiaki Hara; Shigeo Mori; Fumikazu Murakami; Ichiro Horikoshi; Soya Takahasai, all of Tokyo, Japan

[73] Assignee: Kabushiki Kaisha Daini Seikosha, Tokyo, Japan

[21] Appl. No.: 22,144

[22] Filed: Mar. 20, 1979

Related U.S. Application Data

[63] Continuation-in-part of Ser. No. 831,276, Sep. 7, 1977, abandoned.

[30] Foreign Application Priority Data

Sep. 7, 1976 [JP] Japan ..... 51-120367

[51] Int. Cl.[2] ..... G04B 23/12

[52] U.S. Cl. ..... 368/72; 181/160; 310/324; 368/276

[58] Field of Search ..... 58/38, 88 R, 57.5, 23 R, 58/152 B; 179/109; 84/409, 410; 181/148, 155, 156, 160; 310/321, 322, 323, 324, 325

[56] References Cited

U.S. PATENT DOCUMENTS

| | | | |
|---|---|---|---|
| 2,786,326 | 3/1957 | Junghans | 58/57.5 |
| 4,068,461 | 1/1978 | Fassett et al. | 58/57.5 |

*Primary Examiner*—Gene Z. Rubinson
*Assistant Examiner*—Leonard W. Pojunas, Jr.
*Attorney, Agent, or Firm*—Robert E. Burns; Emmanuel J. Lobato; Bruce L. Adams

[57] ABSTRACT

An alarm wristwatch comprises a watchcase having a back with an inclined peripheral portion and a watchband attached to the watchcase at opposite sides. A transducer for generating an alarm signal faces a cavity provided in a rear portion of the watch case. A plurality of sound holes provided in the inclined peripheral portion of the watchcase back open into this cavity. The second holes are located within an angle of 45° on either side of the longitudinal center line of the watchband so that they are not blocked or muffled by the arm of the wearer. The cavity and sound holes are so proportioned as to constitute a Helmholz resonator by which the sound produced by the transducer is intensified and efficiently transmitted to the exterior of the watchcase.

3 Claims, 4 Drawing Figures

ALARM WRISTWATCH

REFERENCE TO PRIOR APPLICATION

This application is a continuation-in-part of our application Ser. No. 831,276 filed Sept. 7, 1977, abandoned.

FIELD OF INVENTION

The present invention is directed to alarm wristwatches and particularly to a construction of the watchcase so that sound emitted by the alarm of the wristwatch is amplified.

BACKGROUND OF THE INVENTION

In the conventional type of an alarm wristwatch sound holes are provided in the back of the watchcase. However, with this construction such sound holes are mostly closed by engagement of the back of the watchcase with the surface of the arm on which the wristwatch is worn. Hence the intensity of the sound emitted by the alarm is greatly attenuated or muffled when the wristwatch is mounted on an arm.

On the other hand, it is undesirable to provide many sound holes in the wristwatch case since this results in decreasing the sound effect.

SUMMARY OF THE INVENTION

The present invention aims to eliminate the above noted difficulties and insufficiencies. The object of the present invention is thus to provide an electronic wristwatch having a watchcase in which sound holes are so disposed as to provide effective emission of the sound generated by the alarm.

In accordance with the invention a transducer for generating an alarm signal faces into a cavity provided in a rear portion of the watchcase. Sound holes opening into this cavity are provided in an inclined peripheral portion of the back of the watchcase and are located in an area within an angle of ±45° from the longitudinal center line of the watchband. Thus for example with respect to an analog watch, this area is located between the 10:30 position and the 1:30 position and between the 4:30 position and 7:30 position. The sound holes thus open into a space which—by virtue of the inclination of the peripheral portion of the back of the watchcase and curvature of an arm on which the watch is worn—is formed between the watchcase and the arm. Hence, the sound holes are not blocked by contact of the watchcase with the arm. Moreover, the cavity in the watchcase and the sound holes are so proportioned as to constitute a Helmholz resonator having a natural frequency corresponding to the frequency of the transducer so that the sound emitted by the transducer is amplified and efficiently transmitted to the exterior of the watchcase.

BRIEF DESCRIPTION OF DRAWINGS

The nature, objects and advantages of the invention will be more fully understood from the following description of a preferred embodiment shown by way of example in the accompanying drawings in which.

DESCRIPTION OF PREFERRED EMBODIMENT

Figure 1:
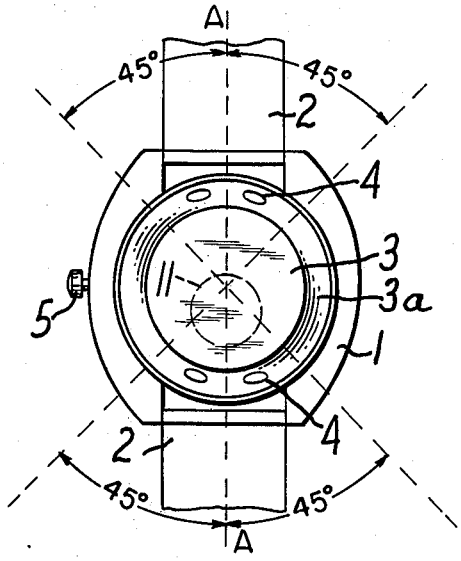
FIG. 1 is a schematic rear view of a watchcase of an alarm wristwatch in accordance with the present invention and adjacent portions of the watchband, FIG. 2. is a schematic rear view of the back of the watchcase showing the location of the area in which the sound holes are located.
Figure 2:
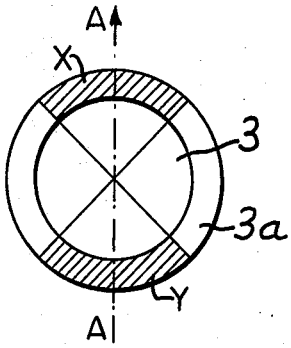

An alarm wristwatch in accordance with the present invention as illustrated by way of example in the drawings comprises a watchcase 1 having a back 3. A watchband 2 is attached to opposite sides of the watchcase for example by pins 8. The back of the watchcase has a sloping peripheral portion **3*a*** which is shaped to obtain a thin appearance of the watchcase and to avoid contact with the arm on which the wristwatch is worn.

A watch is shown as having a stem member 5 and a crystal 9. A watch movement 10, battery 11 and a transducer 12 for generating an alarm sound are indicated schematically by dotted lines in FIG. 3 it being understood that this illustration is not necessarily intended to indicate the size, shape or location of these elements except that the transducer is located at the rear of the watch movement and faces a cavity 13 provided in a rear portion of the watchcase 1 between the watch movement 10 and the back 3.

Figure 3:
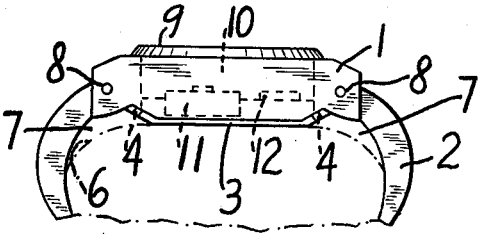
FIG. 3 is a side view of the alarm wristwatch shown mounted on an arm.

As illustrated in FIGS. 1 and 3, sound holes 4 opening into the cavity 13 are provided in the sloping peripheral portion **3*a* of the back 3 of the watchcase. Moreover, as illustrated in FIG. 1, the sound holes 4 are located in areas within an angle of ±45° from the longitudinal center line A—A of the watchband 2. In FIG. 3** these areas are represented by crosshatched portions X and Y. Thus for example in an analog watch, the area X extends between the 10:30 position and the 1:30 position and the rear Y extends between the 4:30 position and the 7:30 position.

FIG. 3 shows the alarm wristwatch mounted on an arm 6 around which the watchband 2 extends. It will be seen that by reason of the curvature of the arm and the inclination of the sloping portion **3*a* of the watchcase back, spaces 7 are provided at opposite sides of the watch between the sloping portion 3*a* of the watchcase back and the arm 6**.

By reason of their location, the sound holes 4 in the sloping portion of the watchcase back open from the cavity 13 into the spaces 7. Thus, as seen in FIG. 3, the sound holes 4 are not closed by engagement of the watchcase with the arm of the wearer and hence a constant volume of the sound emitted through the sound holes is obtained.

Moreover, since none of the sound holes 4 is blocked by engagement of the watchcase with the arm of the wearer, it is possible to obtain a greater volume of sound by selecting the diameter and number of the sound holes 4 and the size of the cavity so that the cavity 13 together with the sound holes 4 constitute a Helmholz resonator having a natural frequency which corresponds to the frequency of the transducer 12 so as to amplify the sound produced by the transducer. Thus the sound holes 4 operate not only to emit the sound but also compose a part of the Helmholz resonator. It is hence undesirable to have a large number of holes on the theory of permitting free transmission of sound waves as in the prior art. Rather the number and size of the sound holes are chosen so as to constitute a Helmholz resonator of the proper frequency. In this way it is possible to increase the sound pressure and to extend the frequency band width by properly establishing the volume of the cavity 13 and the number and size of the sound holes. The structure in accordance with the invention is particularly advantageous in case of using a constant frequency derived from the output of a divider circuit of the watch, for example 4096 Hz, as the driving frequency of the transducer.

Figure 4:
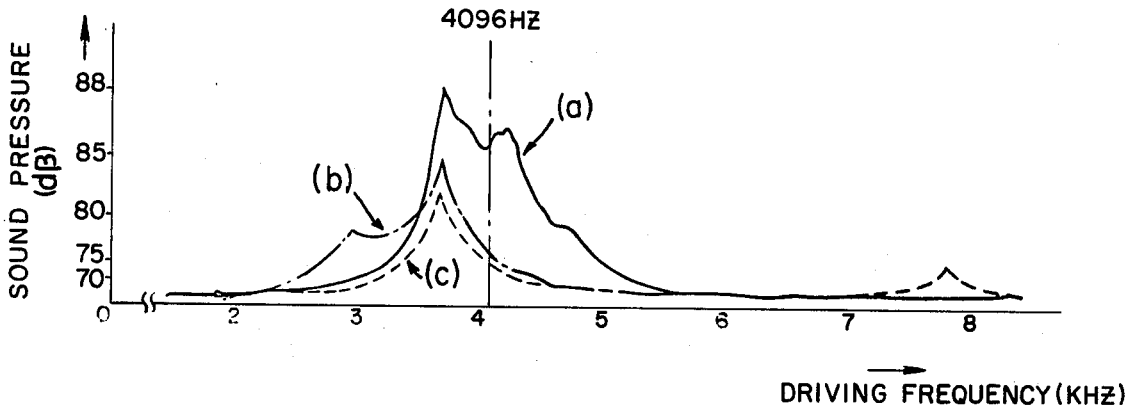
FIG. 4 shows characteristic curves representing sound pressure at different driving frequencies.

In the embodiment shown by way of example in the drawing, there are four sound holes 4, namely a pair of holes at each of opposite sides of the watchcase. Moreover, as seen in FIG. 1, the holes of each pair are located at opposite sides of and spaced from the longitudinal center line A—A of the watchband 2 so that none of the sound holes is blocked or muffled by engagement of the watchcase back with the arm of the wearer. It is important to avoid the blocking of any of the sound holes as this would change the characteristics of the Helmholz resonator comprising the cavity 13 and sound holes 4, so that it no longer responds to the frequency of the transducer. This is illustrated in FIG. 4 where sound pressure in decibles is plotted against driving frequency. Curve (a) shows the characteristic of a Helmholz resonator in accordance with the present invention. It will be seen that there is a band of response in the vicinity of the selected frequency of 4096 Hz of the transducer. Curve (b) shows the condition in which one of the four holes is closed. It will be that there is a significant decrease in the sound pressure. Curve (c) shows the result of having many holes as in the prior art. It will be seen that the sound pressure exhibits a sharp and lower peak.

An example of a construction in accordance with the invention with the transducer 12 driven at a frequency of 4096 Hz is as follows:

EXAMPLE

| | |
|---|---|
| Volume of cavity | 370mm$^3$ |
| Size of each of four oval openings (Holes located as shown in drawings) | 1mm ×, 5.5mm |
| Thickness of case back | |

-continued

| | |
|---|---|
| at the openings | 0.6mm |
| Natural resonating frequency of resonator | 4.3KHz |
| Natural resonating frequency of vibrating plate | 3.8KHz |
| Driving frequency of transducer | 4096Hz |

It will be understood that modifications and variations may be made and that the invention is not limited to the described example.

What is claimed is:

1. An alarm wristwatch comprising a watchcase having a back with an inclined peripheral portion, a watchband attached to said watchcase at opposite sides thereof, a watch movement in a forward portion of said watchcase with a cavity in a rearward portion of said watchcase between said watch movement and said back, a transducer facing into said cavity and driven at a selected frequency to generate an alarm sound, said watchcase having a plurality of sound holes in said inclined peripheral portion opening from said cavity to the atmosphere, said sound holes being located solely within an angle of 45° on either side of the longitudinal center line of said watchband to avoid blocking of any of said holes by the arm of a wearer, the volume of said cavity and the number and size of said sound holes being selected to constitute a Helmholz resonator responsive to the frequency of said transducer to increase the sound pressure generated by said transducer and efficiently transmit the sound to the atmosphere.

2. An alarm wristwatch according to claim 1, in which there are only four of said sound holes consisting of a pair of holes at each of opposite sides of said watchcase, said holes of each pair being on opposite sides of and spaced equally from the longitudinal center line of said watchband.

3. An alarm wristwatch according to claim 1, in which said transducer is driven at a frequency of 4096 Hz.

* * * * *